US012285672B2

(12) United States Patent
Kanda et al.

(10) Patent No.: US 12,285,672 B2
(45) Date of Patent: Apr. 29, 2025

(54) SHAPE RETAINER FOR BASEBALL OR SOFTBALL GLOVE AND SHAPE RETENTION METHOD FOR BASEBALL OR SOFTBALL GLOVE

(71) Applicant: MIZUNO CORPORATION, Osaka (JP)

(72) Inventors: Akihiro Kanda, Osaka (JP); Yuki Yamada, Osaka (JP); Yuya Motegi, Osaka (JP)

(73) Assignee: MIZUNO CORPORATION, Osaka (JP)

( * ) Notice: Subject to any disclaimer, the term of this patent is extended or adjusted under 35 U.S.C. 154(b) by 0 days.

(21) Appl. No.: 18/205,006

(22) Filed: Jun. 2, 2023

(65) Prior Publication Data

US 2023/0390623 A1 Dec. 7, 2023

(30) Foreign Application Priority Data

Jun. 3, 2022 (JP) ..... 2022-091075

(51) Int. Cl.
*A63B 71/14* (2006.01)
*A63B 71/00* (2006.01)

(52) U.S. Cl.
CPC ..... *A63B 71/0045* (2013.01); *A63B 71/143* (2013.01)

(58) Field of Classification Search
CPC ..... A63B 71/0045; A63B 71/143; A63B 2102/18; A63B 2102/182
See application file for complete search history.

(56) References Cited

U.S. PATENT DOCUMENTS 818,178 A * 4/1906 Lane et al. ..... D06F 59/04 223/78
1,736,679 A * 11/1929 Tierney ..... D06F 59/04 223/78
1,981,527 A * 11/1934 Schlag ..... A47F 8/00 223/78
1,997,921 A * 4/1935 Bliss ..... A41D 19/046 223/80
2,091,942 A * 8/1937 Gemeiner ..... A47F 8/00 223/78
2,281,741 A * 5/1942 Boulard ..... A47F 8/00 223/78

(Continued)

FOREIGN PATENT DOCUMENTS

JP 3179144 A 8/1991
JP H05048979 U 6/1993

(Continued)

OTHER PUBLICATIONS

Japanese Office Action dated Sep. 26, 2023 issued in Japanese Patent Application No. 2022-091075.

*Primary Examiner* — Amy J. Sterling
(74) *Attorney, Agent, or Firm* — TROUTMAN PEPPER LOCKE LLP; James E. Schutz; Korbin M. Blunck

(57) ABSTRACT

A shape retainer and a shape retention method are provided, by which the shape of an interior space of an inner part of a baseball or softball glove can be retained precisely. A shape retainer includes a main body having a main surface depressed in a concave shape, so that the shape of the interior space of the inner part of the baseball or softball glove can be retained precisely.

8 Claims, 14 Drawing Sheets

(56) References Cited

U.S. PATENT DOCUMENTS 3,159,504 A * 12/1964 Sarjanian ..... B29C 41/40 223/78
3,477,622 A * 11/1969 Appelt ..... D06F 59/04 223/78
4,018,382 A * 4/1977 DiCuya ..... A41D 19/04 223/78
4,209,913 A * 7/1980 Wallin ..... D06F 59/04 34/103
4,472,836 A * 9/1984 Shikatani ..... D06F 59/04 223/79
D280,743 S * 9/1985 Pregon ..... D20/33
4,697,724 A * 10/1987 Pitcher ..... D06F 59/04 223/78
4,877,162 A * 10/1989 McGinley ..... A47G 25/92 223/78
D393,573 S * 4/1998 Caldwell ..... D7/619.2
5,913,461 A * 6/1999 Boudreau ..... D06F 59/04 223/78
5,976,036 A * 11/1999 Jackson ..... A63B 69/0002 2/19
6,098,853 A * 8/2000 Beitz ..... D06F 59/04 223/78
6,681,402 B1 * 1/2004 Bevier ..... A63B 71/143 2/19
8,871,325 B1 10/2014 Fernandez
9,512,556 B1 * 12/2016 Kazravan ..... D06F 59/04
D790,928 S * 7/2017 Godinez ..... D7/625
9,993,101 B2 * 6/2018 Bryan ..... A47G 25/90
10,265,603 B1 * 4/2019 Nation, Jr. ..... A63B 71/143
2016/0331168 A1 * 11/2016 Godinez ..... H04R 1/028
2018/0028897 A1 * 2/2018 Akin ..... D06F 59/04
2021/0378332 A1 * 12/2021 Tryner ..... A41D 19/015
2022/0219067 A1 * 7/2022 Carpenter ..... A63B 71/143
2024/0139609 A1 * 5/2024 Larsen ..... A63B 71/143

FOREIGN PATENT DOCUMENTS

JP 2005040544 A 2/2005
JP 2006-087782 A 4/2006
JP 2007-202711 A 8/2007
JP 3179144 U 10/2012
JP 2020081688 A 6/2020

* cited by examiner

SHAPE RETAINER FOR BASEBALL OR SOFTBALL GLOVE AND SHAPE RETENTION METHOD FOR BASEBALL OR SOFTBALL GLOVE

CROSS REFERENCE TO RELATED APPLICATIONS

This nonprovisional application is based on Japanese Patent Application No. 2022-091075 filed on Jun. 3, 2022, with the Japan Patent Office, the entire contents of which are hereby incorporated by reference.

BACKGROUND OF THE INVENTION

Field of the Invention

The present invention relates to a shape retainer for a baseball or softball glove, and a shape retention method for a baseball or softball glove.

Description of the Background Art

Various shape retainers have been proposed for restoring the shape of a baseball or softball glove having been deformed and/or deteriorated in hand fitting due to frequent use and/or long-term deterioration, or for correcting the shape of the glove into a desired shape (see, for example, Japanese Patent Laying-Open No. 2007-202711 and Japanese Patent Laying-Open No. 2006-087782). Japanese Patent Laying-Open No. 2007-202711 discloses a shape retaining belt wrapped around the outer periphery of a glove. Japanese Patent Laying-Open No. 2006-087782 discloses a plate-like shape retainer that is plastically deformed into a desired shape after being inserted in an inner part of a glove.

SUMMARY OF THE INVENTION

When the shape retainer disclosed in Japanese Patent Laying-Open No. 2007-202711 is used, a pressure exerted by the belt on the back of the glove may collapse the interior space of an inner part of the glove and thus the shape of the interior space cannot be retained, resulting in deterioration of hand fitting. When the shape retainer disclosed in Japanese Patent Laying-Open No. 2006-087782 is used, the shape of the interior space of the inner part is difficult to retain precisely by the plate-like shape retainer.

The present invention has been made to solve the problems as described above, and an object of the present invention is to provide a shape retainer and a shape retention method for a baseball or softball glove, by which the shape of the interior space of the inner part of the glove can be retained precisely.

A shape retainer according to the present disclosure includes a main body having a main surface depressed in a concave shape.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
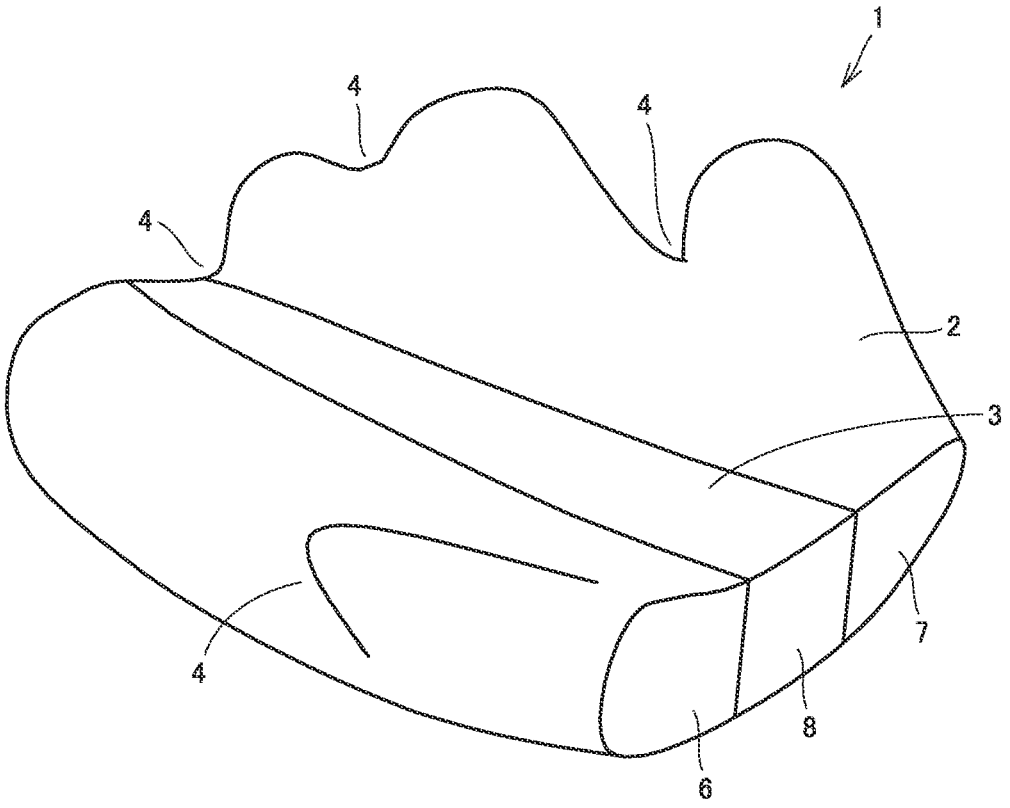
FIG. 1 is a perspective view of a shape retainer for a glove according to Embodiment 1.

Embodiments of the present invention are hereinafter described. In the following drawings, the same or corresponding parts are denoted by the same reference numerals, and a description thereof is not herein repeated, unless otherwise specified.

Embodiment 1

Configuration of Glove Shape Retainer

Figure 2:
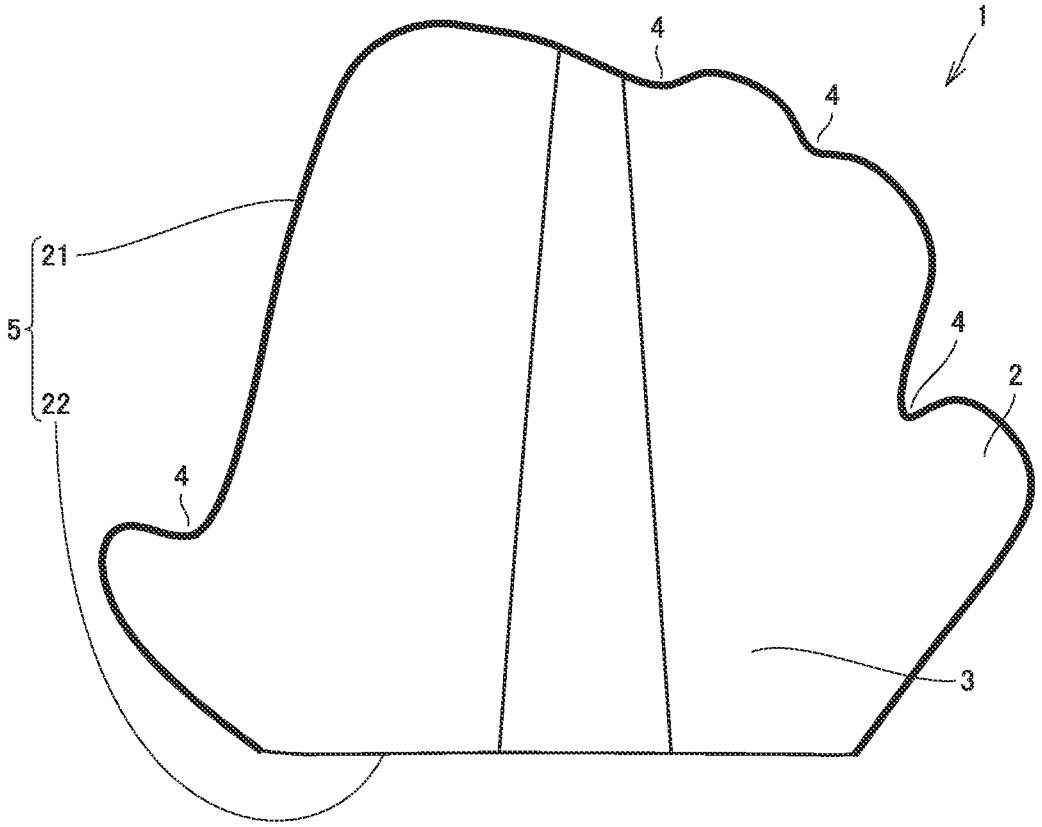
FIG. 2 is a front view of the shape retainer for a glove according to Embodiment 1.
Figure 3:
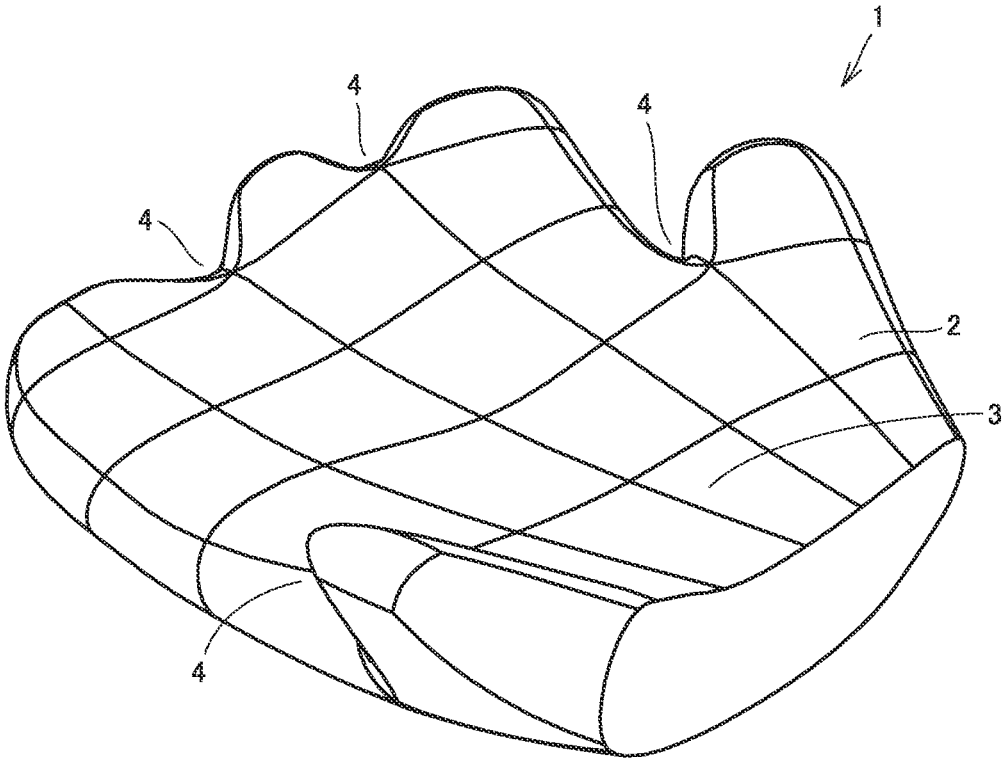
FIG. 3 is a perspective view of a wire frame representation of the shape retainer for a glove according to Embodiment 1.
Figure 4:
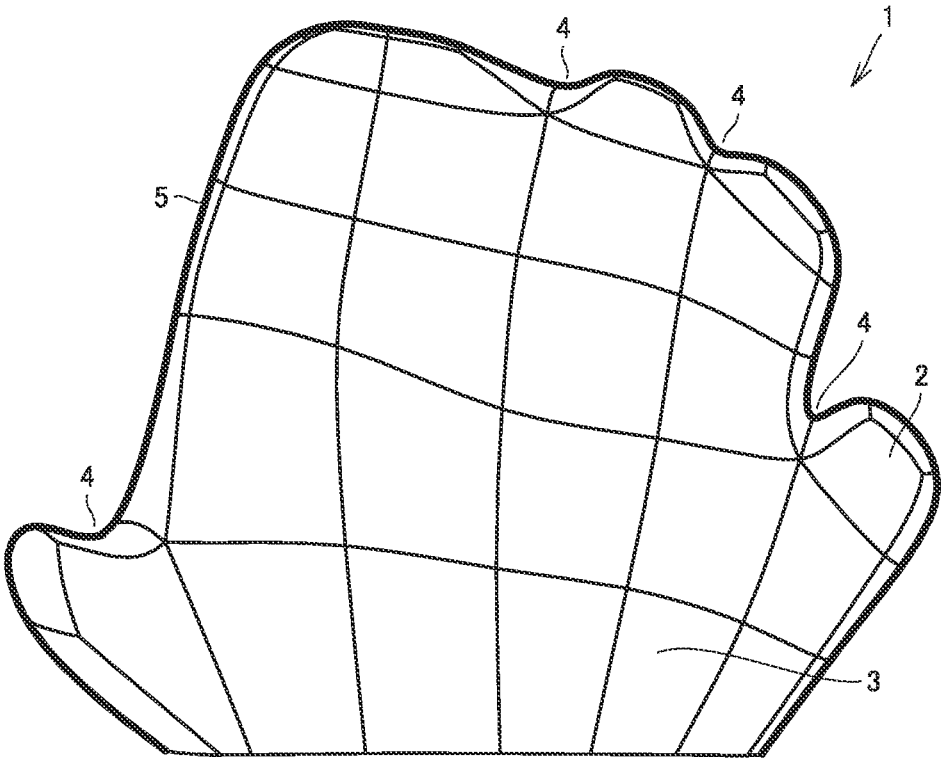
FIG. 4 is a front view of the wire frame representation of the shape retainer for a glove according to Embodiment 1.
Figure 5:
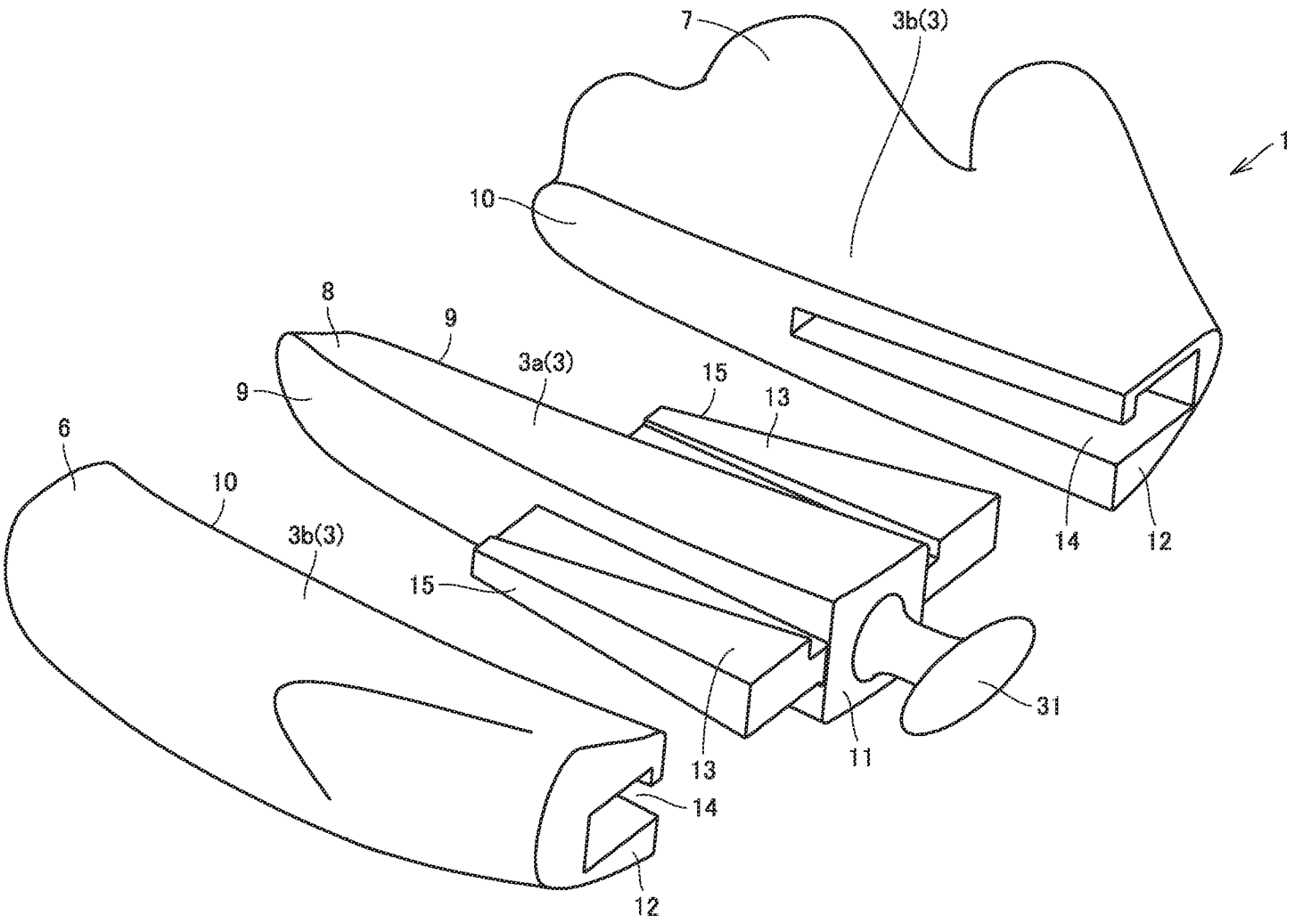
FIG. 5 is a perspective view of the shape retainer, divided into separate portions, for a glove according to Embodiment 1.
Figure 6:
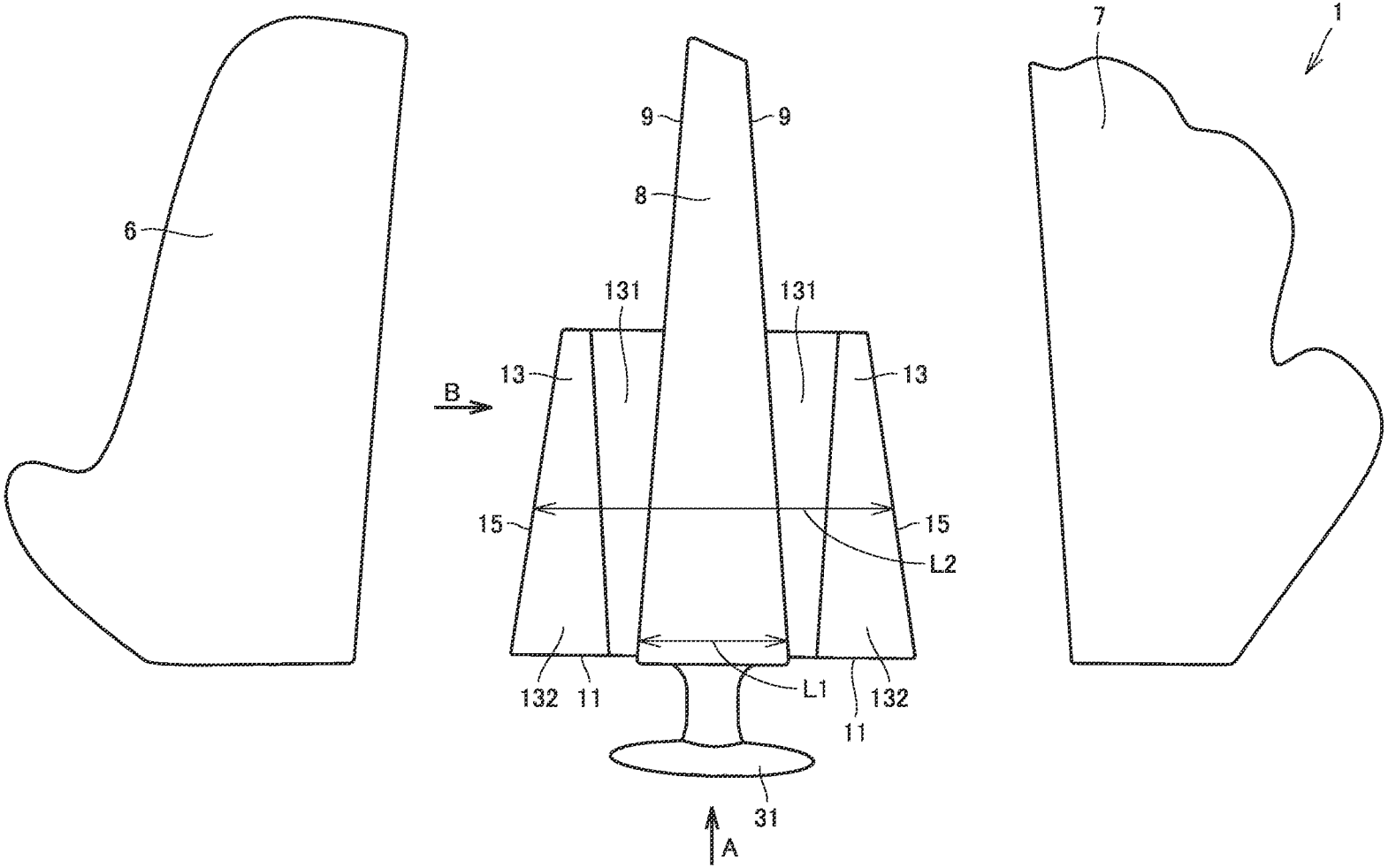
FIG. 6 is a front view of the shape retainer, divided into separate portions, for a glove according to Embodiment 1.
Figure 7:
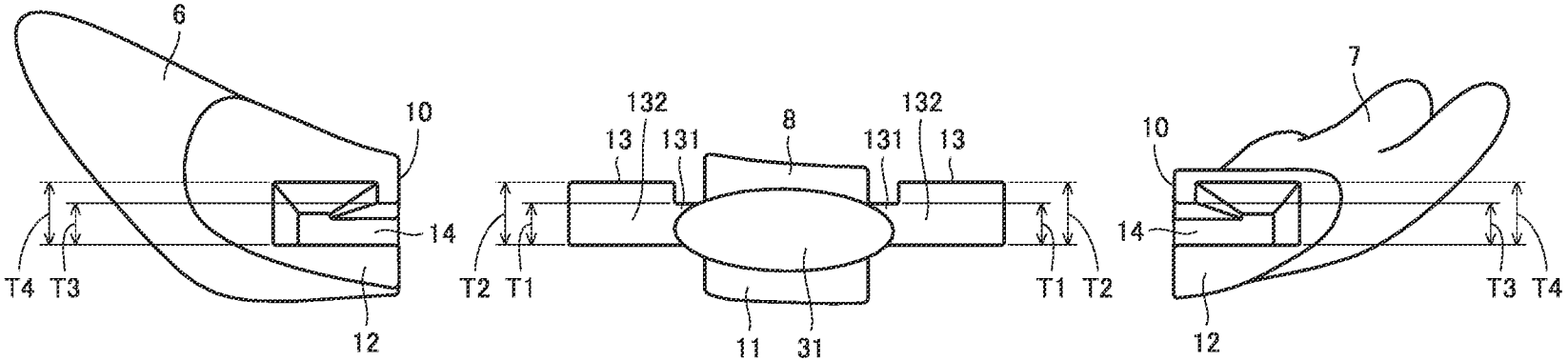
FIG. 7 is a bottom view of the shape retainer, divided into separate portions, for a glove according to Embodiment 1.
Figure 8:
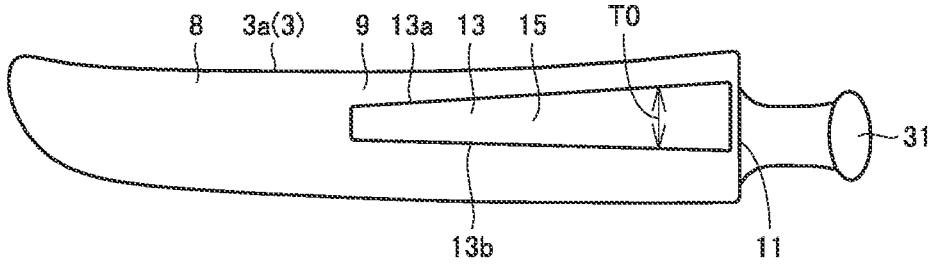
FIG. 8 is a side view of a third portion according to Embodiment 1.
Figure 9:
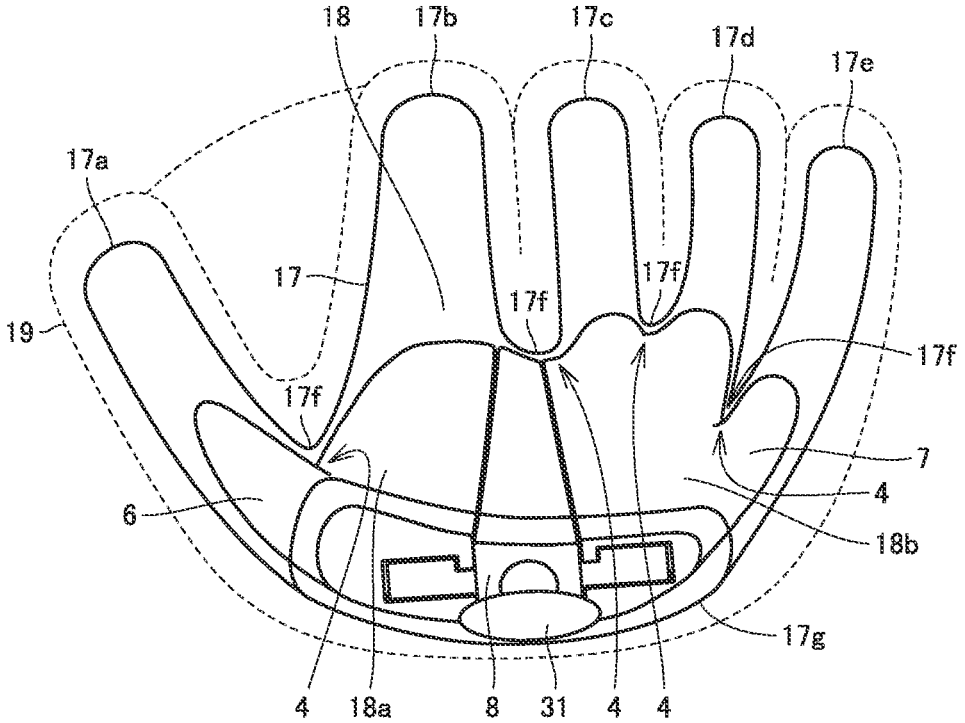
FIG. 9 is a perspective view showing a state in which the shape retainer for a glove according to Embodiment 1 is inserted in an inner part of the glove.

FIG. 1 is a perspective view of a shape retainer 1 according to Embodiment 1. FIG. 2 is a front view of shape retainer 1 in FIG. 1. FIG. 3 is a perspective view of a wire frame representation of shape retainer 1 in FIG. 1. FIG. 4 is a front view of the wire frame representation of shape retainer 1 in FIG. 2. FIG. 5 is a perspective view of shape retainer 1 in FIG. 1 that is divided into three portions. FIG. 6 is a front view of shape retainer 1 divided into three portions in FIG. 2. FIG. 7 is a bottom view of shape retainer 1 divided into three portions, as seen in the direction of an arrow A in FIG. 6. FIG. 8 is a side view of a third portion 8 as seen in the direction of an arrow B in FIG. 6. FIG. 9 is a perspective view showing a state in which glove shape retainer 1 according to Embodiment 1 shown in FIG. 1 is inserted in an inner part 17 of a glove 19.

Shape retainer 1 for a glove shown in FIGS. 1 to 9 is a shape retainer for a baseball glove 19, for example, and chiefly includes a main body 2 having a main surface 3 depressed in a concave shape. As shown in FIGS. 1 and 5, main body 2 can be divided into a first portion 6, a second portion 7, and a third portion 8. As shown in FIGS. 3 and 4, main body 2 of shape retainer 1 has curved main surface 3 depressed in a concave shape. FIGS. 3 and 4 represent the surface shape of shape retainer 1 by means of a virtual wire frame, for the sake of illustrating the surface shape of shape retainer 1 shown in FIGS. 1 and 2. As shown in FIG. 9, shape retainer 1 is used by being inserted in inner part 17 of glove 19. As shown in FIG. 9, shape retainer 1 is inserted in glove 19, such that main surface 3 of main body 2 of shape retainer 1 faces the lining of inner part 17.

As shown in FIG. 2, a perimeter shape 5 of main surface 3 includes a first perimeter portion 21 and a second perimeter portion 22. Second perimeter portion 22 is a region located on the wrist opening side of the glove. Second perimeter portion 22 is formed by a straight line. First perimeter portion 21 is a region that is located in glove 19 and located on the finger stall side of the glove. First perimeter portion 21 is formed by a curved line. In other words, at least a part of perimeter shape 5 is formed by a curved line. Perimeter shape 5 of main surface 3 includes four recesses 4. Specifically, four recesses 4 are formed in perimeter portion 21. Perimeter shape 5 of main surface 3 herein refers to the shape of the perimeter line of main body 2 in plan view of main body 2 as seen from the main surface 3 side as shown in FIG. 2. First perimeter portion 21 of perimeter shape 5 may partially include a straight line.

The shape of main surface 3 is a shape along the shape of the lining of glove 19 (see FIG. 9) (the lining is a portion in contact with the palm of a hand inserted in inner part 17 (see FIG. 9) of glove 19). The shape of the interior space of inner part 17 of a glove which has a favorable shape and of which shape is to be retained (the original shape of the product) may be measured and, based on the measured shape, the shape of main surface 3 may be determined. The shape of the interior space of inner part 17 to be measured includes, for example, the shape of the lining of inner part 17. Thus, shape retainer 1 can be used continuously to suppress deformation of the interior space of inner part 17 of glove 19. Even when glove 19 is deformed due to long-term deterioration, for example, shape retainer 1 can be used to correct the shape of inner part 17 into the shape of inner part 17 of glove 19 at the time of product shipment. The shape of main surface 3 may also be determined based on data other than the shape of the lining of inner part 17 as described above. For example, the shape of main surface 3 may be adapted to conform to the shape of the palm of a user. If glove 19 is for children, the size of shape retainer 1 may be reduced accordingly and the shape of main surface 3 may be changed. The shape and the size of shape retainer 1 may also be changed depending on the type of glove 19. The shape of main surface 3 may also be determined based on the shape of the palm of a famous baseball player.

As shown in FIG. 9, glove 19 of which shape is to be retained includes inner part 17 having a first finger stall 17*a*, a second finger stall 17*b*, a third finger stall 17*c*, a fourth finger stall 17*d*, and a fifth finger stall 17*e* to receive a thumb, an index finger, a middle finger, a ring finger, and a little finger, respectively. Four recesses 4 of main body 2 are each formed such that the recesses each can be placed at a position facing a boundary 17*f* between two finger stalls adjacent to each other, among first finger stall 17*a*, second finger stall 17*b*, third finger stall 17*c*, fourth finger stall 17*d*, and fifth finger stall 17*e*. Recess 4 can be placed at the position facing boundary 17*f* to define the position of shape retainer 1 in glove 19. The number of recesses 4 may not necessarily be four. Each recess 4 may at least be disposed to face boundary 17*f*, such that shape retainer 1 is fixed at a predetermined position in glove 19 when shape retainer 1 is inserted in inner part 17 of glove 19. The number of recesses 4 may therefore be less than four. For example, two recesses 4 in total may be disposed at the position facing boundary 17*f* between first finger stall 17*a* and second finger stall 17*b* and boundary 17*f* between second finger stall 17*b* and third finger stall 17*c*, respectively. Alternatively, the number of recesses 4 may be three. Alternatively, the number of recesses 4 may be one. In this case, the size of main body 2 may at least be determined such that the portion located at perimeter portion 22 (see FIG. 2) of main body 2 of shape retainer 1 is in contact with the wrist opening of glove 19. In other words, the portion where perimeter portion 22 is located and one recess 4 may position shape retainer 1 in glove 19.

As shown in FIG. 9, interior space 18 of inner part 17 includes a first space 18*a* contiguous to first finger stall 17*a* and a second space 18*b* contiguous to fifth finger stall 17*e*. As shown in FIGS. 5 and 9, main body 2 forming shape retainer 1 includes first portion 6, second portion 7, and third portion 8. First portion 6, second portion 7, and third portion 8 are separable from each other. As shown in FIG. 9, first portion 6 is inserted in first space 18*a*. Second portion 7 is inserted in second space 18*b*. Third portion 8 is disposed between first portion 6 and second portion 7.

As shown in FIG. 5, third portion 8 includes two coupling portions 13. Third portion 8 includes a main surface 3*a* forming main surface 3 of main body 2, and a first coupling surface 9 and a first wrist opening surface 11 that are contiguous to main surface 3*a*. Two first coupling surfaces 9 face first portion 6 and second portion 7, with third portion 8 located between first portion 6 and second portion 7. First wrist opening surface 11 crosses two first coupling surfaces 9 and main surface 3*a*. First wrist opening surface 11 is located near a wrist opening 17*g* (see FIG. 9) of glove 19, with shape retainer 1 inserted in glove 19. On first wrist opening surface 11, a knob 31 may be formed. Knob 31 is a part to be gripped by a user of shape retainer 1 for manipulating third portion 8.

Coupling portion 13 is formed to protrude from first coupling surface 9. Coupling portion 13 is located in a region on first wrist opening surface 11 side of first coupling surface 9. As shown in FIG. 6, coupling portions 13 have respective end faces 15 that are located away from respective first coupling surfaces 9. The shape of coupling portions 13 is determined such that a second distance L2 between these end faces 15 decreases gradually, as end faces 15 extend away from first wrist opening surface 11. The direction in which end face 15 extends is a direction along the direction in which first coupling surface 9 closest to end face 15 extends. End face 15 and first coupling surface 9 may be parallel to each other.

As shown in FIG. 6, a first distance L1 between two first coupling surfaces 9 decreases gradually as first coupling surfaces 9 extend away from first wrist opening surface 11. In other words, third portion 8 has a wedge-like shape having first distance L1 decreasing as extending away from first wrist opening surface 11. In other words, first coupling surface 9 extends in a direction inclined with respect to first wrist opening surface 11.

As shown in FIG. 8, coupling portion 13 has a thickness TO decreasing gradually as coupling portion 13 extends away from first wrist opening surface 11. An upper surface 13*a* or a lower surface 13*b* of coupling portion 13 may be inclined with respect to main surface 3*a* In other words, the surface inclined with respect to main surface 3*a* may be only one of upper surface 13*a* and lower surface 13*b* of coupling portion 13. Alternatively, upper surface 13*a* and lower surface 13*b* of coupling portion 13 may be parallel to each other.

As shown in FIGS. 6 and 7, coupling portion 13 includes a first region 131 and a second region 132 that are located away from first coupling surface 9. Second region 132 is located further away from first coupling surface 9 than first region 131 is. A second thickness T2 of second region 132 is larger than a first thickness T1 of first region 131. As shown in FIG. 6, second region 132 having relatively larger thickness T2 has its width (width in the direction along main surface 3) that decreases as region 132 extends away from first wrist opening surface 11. First region 131 having relatively smaller thickness T1 has its width that increases as region 131 extends away from first wrist opening surface 11.

As shown in FIG. 5, first portion 6 and second portion 7 each have a groove 14 in which coupling portion 13 of third portion 8 is inserted. First portion 6 and second portion 7 each have a main surface 3*b* forming main surface 3 of main body 2, a second coupling surface 10 contiguous to main surface 3*b*, and a second wrist opening surface 12. Second coupling surface 10 faces first coupling surface 9 of third portion 8. Second wrist opening surface 12 crosses second coupling surface 10 and main surface 3*b*. In first portion 6 and second portion 7 each, groove 14 is formed in second coupling surface 10. Groove 14 is provided to extend from a substantially central portion of second coupling surface 10 to second wrist opening surface 12. In groove 14, a region relatively closer to second coupling surface 10 has a width T3 that is smaller than a width T4 of a region relatively further from second coupling surface 10, to conform to the shape of coupling portion 13 shown in FIG. 7.

First wrist opening surface 11 and second wrist opening surfaces 12 of main body 2 are located on the same side and are coplanar, for example. Coupling portions 13 of third portion 8 are inserted to respective grooves 14 of first portion 6 and second portion 7, to thereby couple first portion 6, second portion 7, and third portion 8 to each other.

Figure 10:
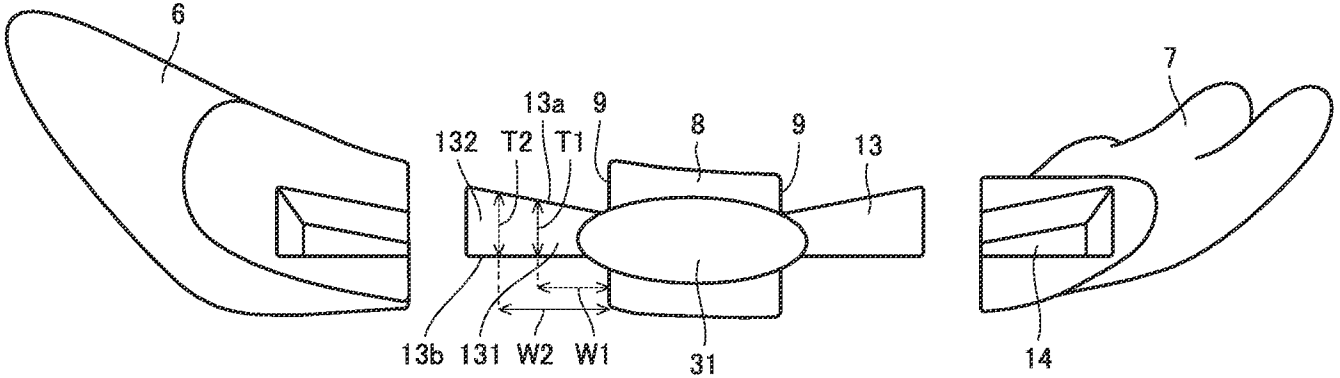
FIG. 10 is a bottom view of a shape retainer for a glove in Modification 1 of coupling portions and grooves, according to Embodiment 1.

FIG. 10 is a bottom view of Modification 1 of shape retainer 1 according to Embodiment 1. FIG. 10 corresponds to FIG. 7. Shape retainer 1 shown in FIG. 10 basically has a configuration similar to shape retainer 1 shown in FIGS. 1 to 9, except that the configuration of coupling portion 13 differs from shape retainer 1 shown in FIGS. 1 to 9. Specifically, regarding shape retainer 1 shown in FIG. 10, the thickness of coupling portion 13 increases gradually as coupling portion 13 extends away from first coupling surface 9. Groove 14 is a groove having a trapezoidal cross section to conform to the shape of coupling portion 13. In coupling portion 13, a region to a distance W1 from first coupling surface 9 is referred to as first region 131. First region 131 has thickness T1. A region to a distance W2 from first coupling surface 9 is referred to as second region 132. Second region 132 has thickness T2. Thickness T2 is larger than thickness T1. In any region of coupling portion 13 of shape retainer 1 shown in FIG. 10, when first region 131 and second region 132 are defined as being located at different distances from first coupling surface 9 as described above, thickness T2 is larger thickness T1.

Lower surface 13*b* of coupling portion 13 is formed to extend in the direction substantially perpendicular to first coupling surface 9. Upper surface 13*a* is formed to incline with respect to lower surface 13*b*. Upper surface 13*a*, which is a surface relatively closer to main surface 3, may be formed to extend in the direction substantially perpendicular to first coupling surface 9. In this case, lower surface 13*b* is formed to incline with respect to upper surface 13*a*. Alternatively, both of upper surface 13*a* and lower surface 13*b* may be formed to extend in a direction inclined with respect to first coupling surface 9.

Figure 11:
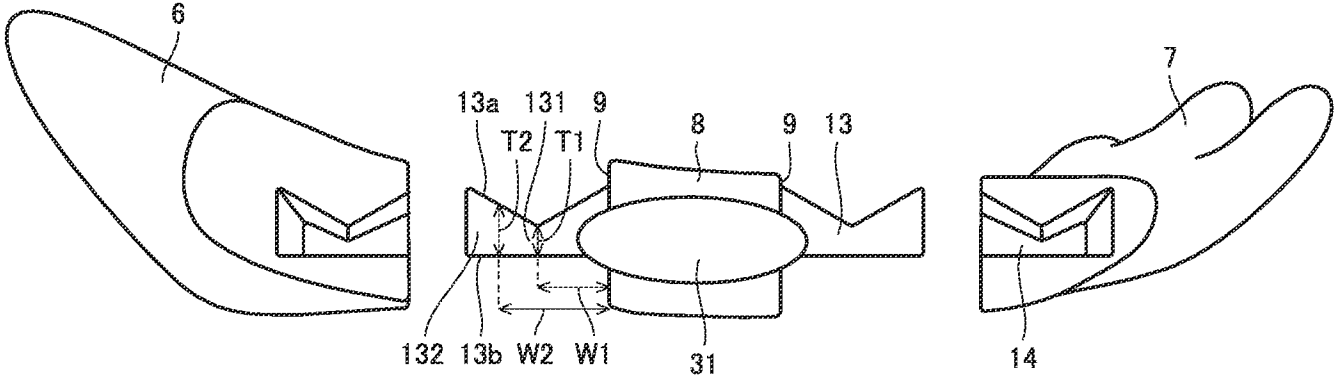
FIG. 11 is a bottom view of a shape retainer for a glove in Modification 2 of coupling portions and grooves, according to Embodiment 1.

FIG. 11 is a bottom view of Modification 2 of shape retainer 1 according to Embodiment 1. FIG. 11 corresponds to FIG. 7. Shape retainer 1 shown in FIG. 11 basically has a configuration similar to shape retainer 1 shown in FIGS. 1 to 9, except that the configuration of coupling portion 13 differs from shape retainer 1 shown in FIGS. 1 to 9. Groove 14 is a groove having one of sidewalls that has a protruded shape protruding inward to conform to the shape of coupling portion 13. Specifically, in shape retainer 1 shown in FIG. 11, coupling portion 13 has its thickness decreasing gradually as it extends from first coupling surface 9 toward first region 131. First region 131 is a region to distance W1 from first coupling surface 9. Distance W1 may be a half of the width of coupling portion 13, for example. In a region to a greater distance from first coupling surface 9 than W1, i.e., in the region outside first region 131, the thickness of coupling portion 13 increases gradually. First region 131 has thickness T1. Second region 132 is defined as a region located outside first region 131 and having a distance W2 from first coupling surface 9. Second region 132 has thickness T2. Distance W2 is larger than distance W1. Thickness T2 is larger than thickness T1.

Lower surface 13*b* of coupling portion 13 is formed to extend in the direction substantially perpendicular to first coupling surface 9. Upper surface 13*a* is formed to incline with respect to lower surface 13*b*. In other words, upper surface 13*a* may have a cross section in the shape of a V-shaped groove. Upper surface 13*a* is a side surface in the groove shape. Upper surface 13*a* may be formed to extend in the direction substantially perpendicular to first coupling surface 9. In this case, lower surface 13*b* may be formed to incline with respect to upper surface 13*a* Alternatively, both of upper surface 13*a* and lower surface 13*b* may be formed by a surface extending in a direction inclined with respect to first coupling surface 9. For example, both upper surface 13*a* and lower surface 13*b* may have a cross section in the shape of a V-shaped groove.

As a material forming above-described shape retainer 1, any material may be used. For example, plastic resin, wood, or metal such as aluminum may be used as the material.

Glove Shape Retention Method

Figure 12:
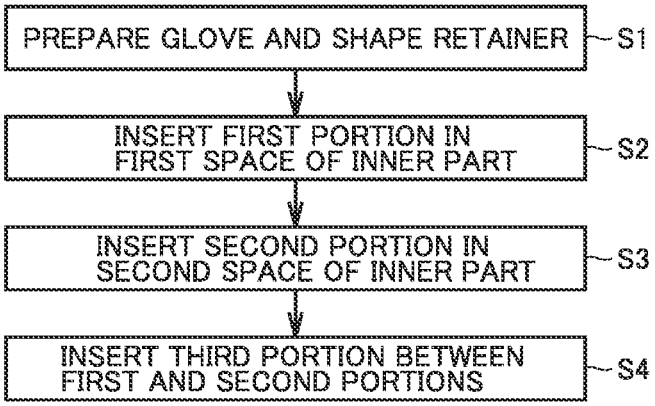
FIG. 12 is a flowchart showing a shape retention method with a shape retainer for a glove according to Embodiment 1.

FIG. 12 is a flowchart illustrating a shape retention method for glove 19 according to Embodiment 1. FIGS. 13 to 16 are each a perspective view showing a step of retaining the shape of inner part 17 of glove 19.

Figure 13:
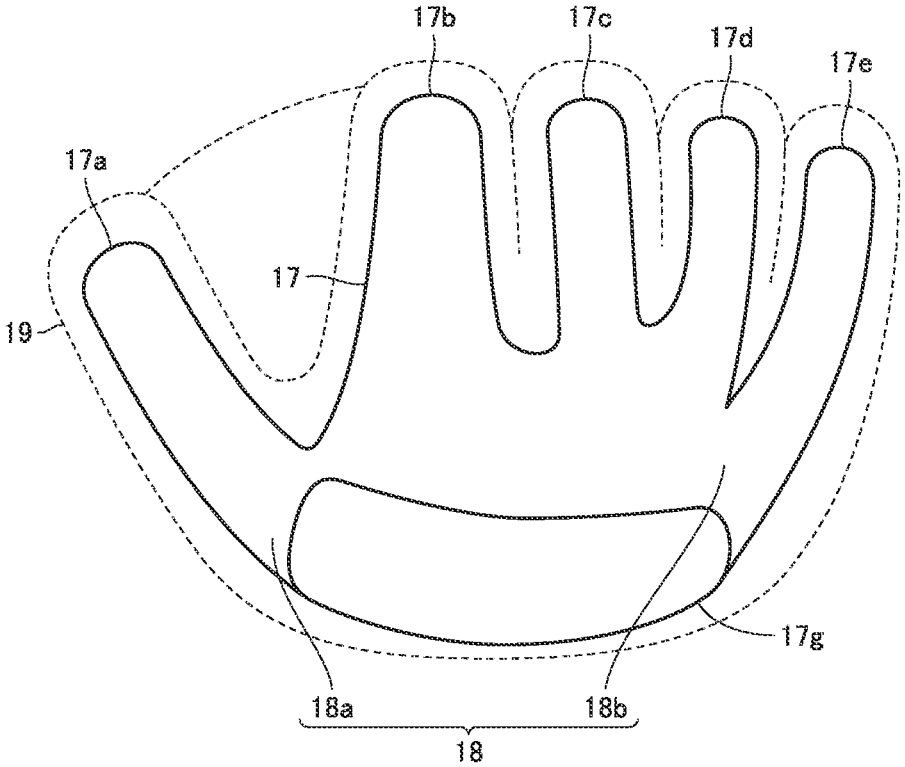
FIG. 13 is a perspective view showing a step of the shape retention method with the shape retainer for a glove according to Embodiment 1.

As shown in FIG. 12, according to the shape retention method for glove 19, the step of preparing glove 19 and shape retainer 1 is performed (S1). As shown in FIG. 13, prepared glove 19 includes inner part 17. Interior space 18 of inner part 17 includes first space 18*a* and second space 18*b* as described above.

Figure 14:
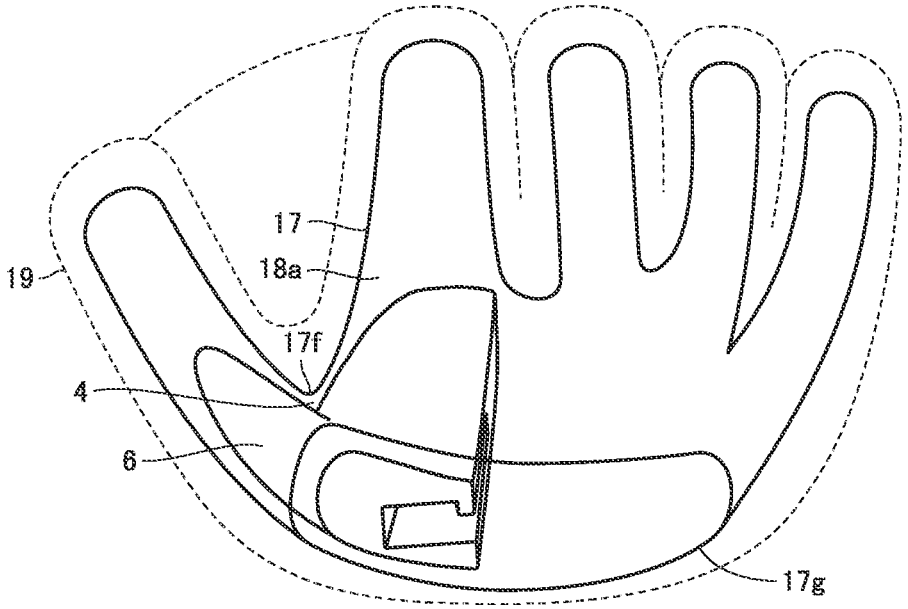
FIG. 14 is a perspective view showing a step performed after the step shown in FIG. 13 according to Embodiment 1.

Next, the step of inserting first portion 6 in first space 18*a* of inner part 17 is performed (S2). In this step (S2), as shown in FIG. 14, first portion 6 of shape retainer 1 (see FIG. 1) is inserted in first space 18*a* of interior space 18 of inner part 17, from wrist opening 17*g* of glove 19.

Figure 15:
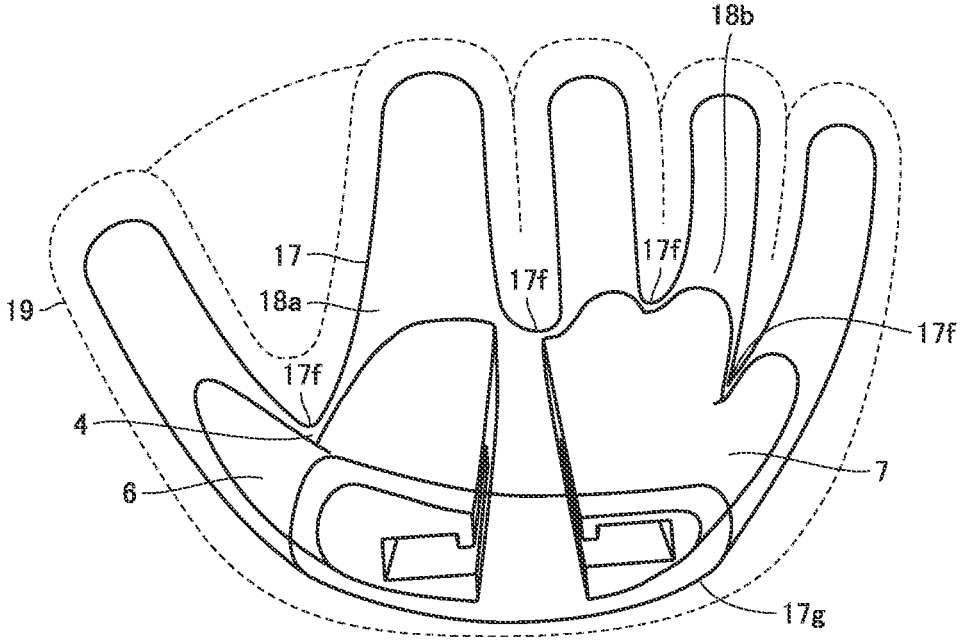
FIG. 15 is a perspective view showing a step performed after the step shown in FIG. 14 according to Embodiment 1.

Next, the step of inserting second portion 7 in second space 18*b* of inner part 17 is performed (S3). In this step (S3), as shown in FIG. 15, second portion 7 is inserted in second space 18*b* of interior space 18 of inner part 17, from wrist opening 17*g* of glove 19. The step (S3) may be performed prior to the above-described step (S2).

Next, the step of inserting third portion 8 between first portion 6 and second portion 7 is performed (S4). In this step (S4), third portion 8 is inserted in inner part 17 from wrist opening 17*g* of glove 19, such that third portion 8 is located between first portion 6 and second portion 7. At this time, third portion 8 is inserted in inner part 17 such that coupling portions 13 of third portion 8 fit in respective grooves 14 provided in first portion 6 and second portion 7. In this way, as shown in FIG. 9, shape retainer 1 into which first portion 6, second portion 7, and third portion 8 are integrated is disposed in inner part 17 of glove 19. As a result, the shape of glove 19 is maintained by shape retainer 1.

When shape retainer 1 is to be removed from inside glove 19, the above-described steps may be performed in the reverse order.

Functions and Advantageous Effects

Shape retainer 1 for glove 19 according to the present disclosure includes main surface 3 depressed in a concave shape, which is the shape of the lining of glove 19.

Thus, shape retainer 1 can be used while glove 19 is stored to prevent glove 19, particularly inner part 17, from deforming. Even when glove 19 has been deformed due to long-term deterioration, for example, shape retainer 1 can be used to correct the shape of inner part 17 into the original shape of inner part 17 of glove 19 at the time of product shipment. As the material for glove 19, natural leather is commonly used, and therefore, many handwork steps are involved in the manufacturing process. As a result, the shape of inner part 17 may also vary between manufactured gloves 19, resulting in lack of quality stability. In view of this, shape retainer 1 having main surface 3 having its shape along the shape of the lining of the glove can be used after glove 19 is manufactured, to thereby make respective shapes of inner parts 17 uniform. As a result, the shape can be made stable to suppress variations of the glove shape occurring after the glove is manufactured.

In shape retainer 1, main surface 3 has perimeter shape 5 including at least two or more recesses 4, and recesses 4 can each be placed at a position facing boundary 17*f* between two finger stalls adjacent to each other, among first finger stall 17*a*, second finger stall 17*b*, third finger stall 17*c*, fourth finger stall 17*d*, and fifth finger stall 17*e*. Thus, recess 4 can be located at boundary 17*f* of finger stalls adjacent to each other to restrain movement of shape retainer 1 in inner part 17. Accordingly, the shape of glove 19 can be retained stably by shape retainer 1.

In shape retainer 1, at least a part of perimeter shape 5 of main surface 3 is formed by a curved line. Thus, when shape retainer 1 is inserted in inner part 17 of glove 19, the frequency at which shape retainer 1 is caught by glove 19 can be reduced so that shape retainer 1 can be inserted easily in inner part 17 of glove 19.

In shape retainer 1, main body 2 includes first portion 6, second portion 7, and third portion 8. The first portion is inserted in first space 18*a*. Second portion 7 is inserted in second space 18*b*. Third portion 8 is disposed between first portion 6 and second portion 7. First portion 6, second portion 7, and third portion 8 are separable from each other. Thus, without undoing laces of glove 19, first portion 6, second portion 7, and third portion 8 can be inserted separately in inner part 17 from wrist opening 17*g* of glove 19.

In shape retainer 1, third portion 8 includes two coupling portions 13. First portion 6 and second portion 7 have respective grooves 14 in which coupling portions 13 of third portion 8 are inserted. Thus, coupling portions 13 are inserted in grooves 14 to integrate first portion 6, second portion 7, and third portion 8 together. Accordingly, after shape retainer 1 is inserted in glove 19, the shape of shape retainer 1 can be prevented from deforming to thereby retain the shape of glove 19 stably.

In shape retainer 1, as shown in FIG. 6, first distance L1 between two first coupling surfaces 9 decreases gradually as first coupling surfaces 9 extend away from first wrist opening surface 11. Thus, the width of the distal end (most distal end from first wrist opening surface 11) of third portion 8 is relatively smaller. It is therefore easy to firstly insert the distal end of third portion 8 in inner part 17. Moreover, first coupling surfaces 9 are inclined (tapered) in the direction toward the distal end (the insert direction) from first wrist opening surface 11. Thus, when third portion 8 is inserted, first portion 6 and second portion 7 that are in contact with respective first coupling surfaces 9 move laterally, as third portion 8 is inserted. As a result, first portion 6 and second portion 7 can be moved in inner part 17 toward the opposite ends of inner part 17 (toward first space 18*a* and second space 18*b*, respectively).

In shape retainer 1, coupling portions 13 have respective end faces 15 that are located away from respective first coupling surfaces 9. As shown in FIG. 6, second distance L2 between these end faces 15 decreases gradually, as end faces 15 extend away from first wrist opening surface 11. In other words, coupling portions 13 have a tapered shape increasing in width (second distance L2 between end faces 15) gradually toward first wrist opening surface 11. Thus, when coupling portions 13 are inserted in respective grooves 14, first portion 6 and second portion 7 that are in contact with respective end faces 15 move laterally, as coupling portions 13 are inserted in respective grooves 14. As a result, first portion 6 and second portion 7 can be moved in inner part 17 toward the opposite ends of inner part 17 (toward first space 18*a* and second space 18*b*, respectively).

In shape retainer 1, as shown in FIG. 8, coupling portion 13 has thickness TO decreasing gradually as coupling portion 13 extends away from first wrist opening surface 11. In this case, even when the position of coupling portion 13 is somewhat displaced in the direction of thickness TO of coupling portion 13, coupling portion 13 can be inserted easily in groove 14.

In shape retainer 1, coupling portion 13 includes first region 131 located away from first coupling surface 9 and second region 132 located further away from first coupling surface 9 than first region 131 is. Second thickness T2 of second region 132 is larger than first thickness T1 of first region 131. Moreover, the cross-sectional shape of respective grooves 14 formed in first portion 6 and second portion 7 is a shape conforming to the cross-sectional shape of coupling portion 13. In other words, with coupling portion 13 inserted in groove 14, the width (width in the direction along thickness T1) of groove 14 of the portion where first region 131 is located is larger than the width (width in the direction along thickness T2) of groove 14 of the portion where second region 132 is located. Therefore, with coupling portions 13 inserted in respective grooves 14, respective positions of first portion 6, second portion 7, and third portion 8 relative to each other can reliably be determined.

Embodiment 2

Configuration of Glove Shape Retainer

Figure 16:
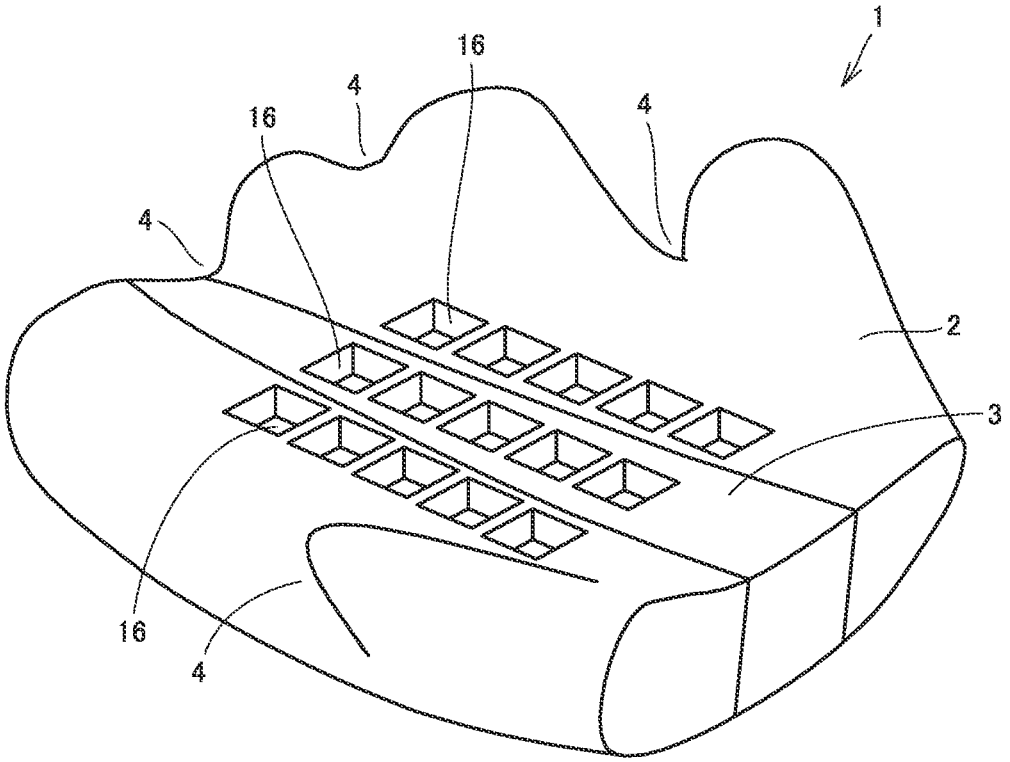
FIG. 16 is a perspective view of a shape retainer for a glove according to Embodiment 2.

FIG. 16 is a perspective view of a shape retainer for a glove according to Embodiment 2. FIG. 16 corresponds to FIG. 1. Shape retainer 1 shown in FIG. 16 basically has a configuration similar to shape retainer 1 shown in FIGS. 1 to 9, except that a plurality of hollows 16 are arranged in a matrix in the surface of shape retainer 1, in contrast to shape retainer 1 shown in FIGS. 1 to 9. Specifically, in shape retainer 1 shown in FIG. 16, hollows 16 that are recess-shaped portions are formed in main surface 3 of main body 2. While the arrangement of a plurality of hollows 16 may be the matrix as shown in FIG. 16, the arrangement may be any arrangement other than this, such as triangular arrangement, random arrangement. The shape of hollow 16 as seen in plan view is a rectangular shape. The shape of hollow 16 as seen in plan view may be any other than the rectangular shape. For example, the shape of the hollow as seen in plan view may be a circular, triangular, or hexagonal shape, for example. Hollow 16 has a bottom therein, and hollow 16 may extend from main surface 3 to the surface of main body 2 opposite to main surface 3. In other words, hollow 16 may be formed to extend through main body 2. A plurality of hollows 16 are formed in each of first portion 6, second portion 7, and third portion 8. Hollows 16 may be formed in at least any one of first portion 6, second portion 7, and third portion 8. The arrangement of hollows 16 in main surface 3 may be determined in any manner. For example, hollows 16 may be formed in an outer peripheral portion of main surface 3 and may not be formed in the central portion of main surface 3, or hollows 16 may alternatively be formed only in the central portion of main surface 3.

Figure 17:
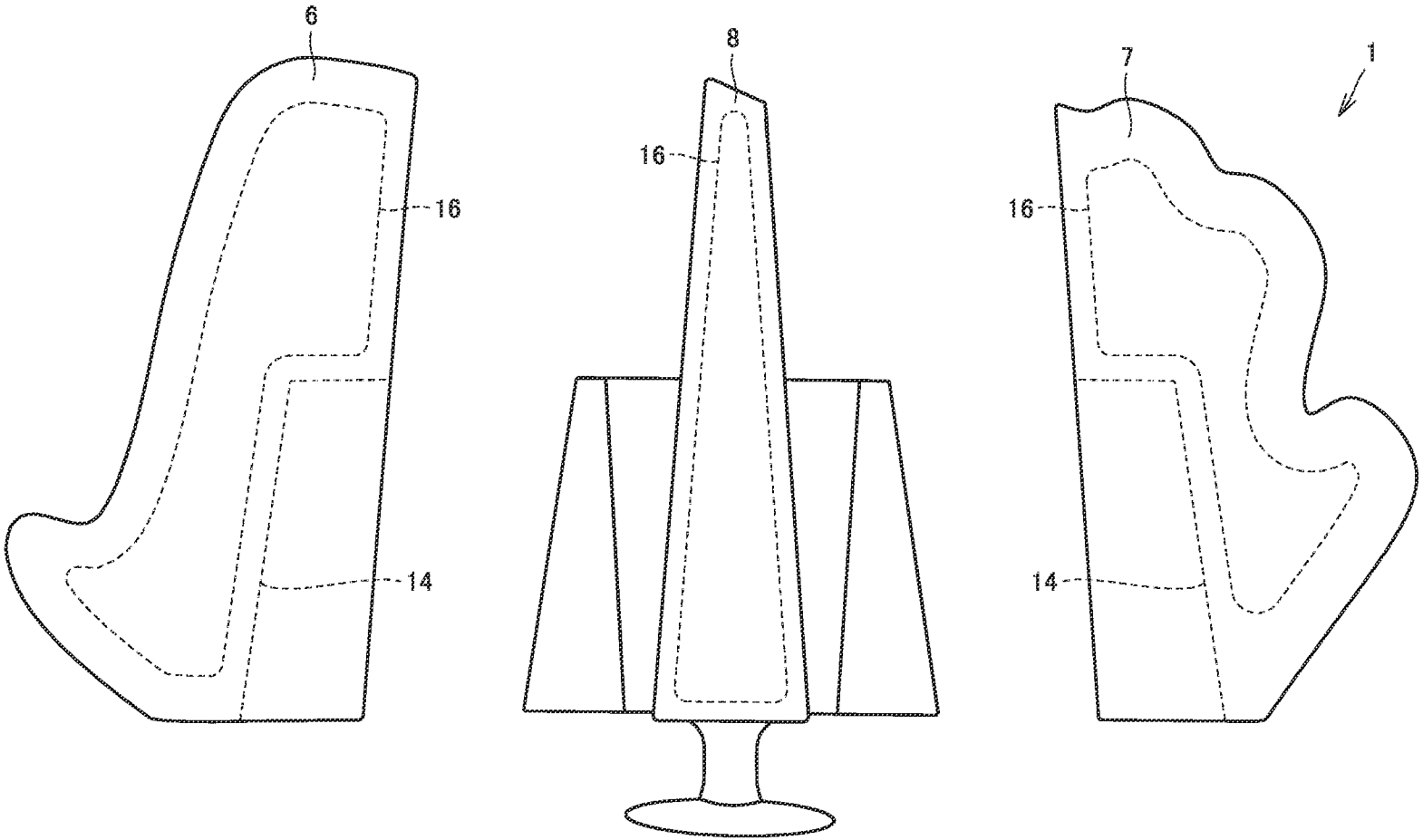
FIG. 17 is a front view of a shape retainer according to Modification 1 of the shape retainer, according to Embodiment 2.

FIG. 17 is a front view of Modification 1 of the shape retainer fora glove according to Embodiment 2. FIG. 17 corresponds to FIG. 6. Shape retainer 1 shown in FIG. 17 basically has a configuration similar to shape retainer 1 shown in FIGS. 1 to 9, except that hollows 16 are provided in shape retainer 1, in contrast to shape retainer 1 shown in FIGS. 1 to 9. Specifically, in shape retainer 1 shown in FIG. 17, respective hollows 16 are formed in first portion 6, second portion 7, and third portion 8 that form main body 2. The shape of hollows 16 as seen in plan view is a shape conforming to the shape of first portion 6, second portion 7 or third portion 8 as seen in plan view. In third portion 8, hollow 16 is not formed in coupling portion 13, for the sake of ensuring adequate strength of coupling portion 13. The shape of hollow 16 as seen in plan view may be any shape other than the above-described one. For example, the shape of hollow 16 as seen in plan view may be a polygonal shape, such as rectangular, circular, elliptical, triangular, or pentagonal shape. Hollow 16 may be formed in at least one of first portion 6, second portion 7, and third portion 8.

Functions and Advantageous Effects

In shape retainers 1 shown in FIGS. 16 and 17, hollow 16 is present in the surface of or inside main body 2. Hollow 16 refers to both the recess formed in main surface 3 of main body 2 shown in FIG. 16 and the hollow embedded in main body 2 shown in FIG. 17. In this case, the volume of main body 2 is smaller than shape retainer 1 shown in FIGS. 1 to 9, and therefore, the weight of shape retainer 1 can be reduced. As a result, shape retainer 1 is easier to handle.

It should be construed that the embodiments disclosed herein are given by way of illustration in all respects, not by way of limitation. At least two or more of the embodiments disclosed herein may be combined unless there is an inconsistency in the combination. It is intended that the scope of the present invention is defined by claims, not by the description above, and encompasses all modifications equivalent in meaning and scope to the claims.

What is claimed is:

1. A shape retainer for a baseball or softball glove, the shape retainer comprising a main body having a main surface depressed in a concave shape, wherein:

the baseball or softball glove includes:

an inner part having a first finger stall, a second finger stall, a third finger stall, a fourth finger stall, and a fifth finger stall to receive a thumb, an index finger, a middle finger, a ring finger, and a little finger, respectively, and; an interior space of the inner part includes:

a first space contiguous to the first finger stall; and a second space contiguous to the fifth finger stall; and the main body includes:

a first portion to be inserted in the first space;

a second portion to be inserted in the second space; and a third portion to be placed between the first portion and the second portion, the first portion, the second portion, and the third portion each being separable from each other, and wherein the third portion includes:

two first coupling surfaces facing the first portion and the second portion respectively; and coupling portions formed to protrude from the two first coupling surfaces respectively, the coupling portions each comprising:

a first region extending outwardly from the first coupling surface a first distance and having a first thickness extending in a direction from a front of the third portion to a back of the third portion, the front of the third portion configured to face a palmar side of the baseball or softball glove and the back of the third portion configured to face a dorsal side of the baseball or softball glove; and a second region extending outwardly from the first region to a second distance from the first coupling surface and having a second thickness extending in the direction from the front of the third portion to the back of the third portion, the second distance being greater than the first distance and the second thickness being greater than the first thickness;

wherein the first portion and the second portion each include:

second coupling surfaces facing the first coupling surfaces respectively; and a groove configured to receive the first region and the second region of the coupling portions.

2. The shape retainer for a baseball or softball glove according to claim 1, wherein the main surface of the main body has a perimeter shape including at least two or more recesses, and the recesses can each be placed at a position facing a boundary between two finger stalls adjacent to each other, among the first finger stall, the second finger stall, the third finger stall, the fourth finger stall, and the fifth finger stall.

3. The shape retainer for a baseball or softball glove according to claim 1, wherein the third portion further includes:

a first wrist opening surface crossing the main surface and the first coupling surfaces, the first portion and the second portion further include:

respective second wrist opening surfaces crossing the main surface and the second coupling surfaces, the first wrist opening surface and the second wrist opening surfaces of the main body are located on the same side, and the groove is formed to reach the second wrist opening surface.

4. The shape retainer for a baseball or softball glove according to claim 3, wherein a first distance between the two first coupling surfaces decreases gradually as the two coupling surfaces extend away from the first wrist opening surface.

5. The shape retainer for a baseball or softball glove according to claim 3, wherein the two coupling portions have respective end faces located away from the first coupling surfaces respectively, and a second distance between the end faces decreases gradually as the end faces extend away from the first wrist opening surface.

6. The shape retainer for a baseball or softball glove according to claim 3, wherein the coupling portions each have a thickness decreasing gradually as the coupling portion extends away from the first wrist opening surface.

7. The shape retainer for a baseball or softball glove according to claim 2, wherein at least a part of the perimeter shape of the main surface is formed by a curved line.

8. The shape retainer for a baseball or softball glove according to claim 1, wherein a hollow is present in a surface of or inside the main body.

* * * * *